US006597317B2

(12) United States Patent
Talvitie

(10) Patent No.: US 6,597,317 B2
(45) Date of Patent: Jul. 22, 2003

(54) RADIO DEVICE AND ANTENNA STRUCTURE

(75) Inventor: Olli Talvitie, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 10/027,830

(22) Filed: Oct. 25, 2001

(65) Prior Publication Data

US 2002/0060644 A1 May 23, 2002

(30) Foreign Application Priority Data

Oct. 27, 2000 (FI) ..... 20002376

(51) Int. Cl.[7] ..... H01Q 1/38
(52) U.S. Cl. ..... 343/700 MS; 343/702; 343/767
(58) Field of Search ..... 343/700 MS, 702, 343/767, 845

(56) References Cited

U.S. PATENT DOCUMENTS

| | | | | |
|---|---|---|---|---|
| 4,571,595 A | | 2/1986 | Phillips et al. | 343/745 |
| 6,008,762 A | | 12/1999 | Nghiem | 343/700 |
| 6,160,513 A | * | 12/2000 | Davidson et al. | 343/700 MS |
| 6,225,958 B1 | * | 5/2001 | Amano et al. | 343/767 |
| 6,252,552 B1 | * | 6/2001 | Tarvas et al. | 343/700 MS |
| 6,343,208 B1 | * | 1/2002 | Ying | 343/702 |
| 6,346,914 B1 | * | 2/2002 | Annamaa | 343/700 MS |
| 6,380,905 B1 | * | 4/2002 | Annamaa et al. | 343/700 MS |

FOREIGN PATENT DOCUMENTS

| | | |
|---|---|---|
| CH | 690945 A5 | 2/2001 |
| EP | 1020948 A1 | 7/2000 |
| WO | WO 00/03452 | 1/2000 |
| WO | WO 01/47059 A1 | 6/2001 |

* cited by examiner

*Primary Examiner*—Don Wong
*Assistant Examiner*—Shih-Chao Chen
(74) *Attorney, Agent, or Firm*—Perman & Green, LLP

(57) ABSTRACT

A radio device and an antenna structure, wherein a groove (103) provided in a planar radiator (110) of the antenna is used to generate resonances for different frequency ranges, enabling the generation of more than one separate frequency ranges and at least one frequency range covering several mobile communication system bandwidths used. The groove (103) is implemented on the planar radiator (110) such that at least part of the groove is located between a feed point (101) and a ground point (102).

15 Claims, 7 Drawing Sheets

RADIO DEVICE AND ANTENNA STRUCTURE

FIELD OF THE INVENTION

The present invention relates to small antenna structures. The invention relates particularly to internal antennas that are used in mobile stations and that are fed from one feed point.

BACKGROUND OF THE INVENTION

Particularly the increasingly diminishing size of mobile stations sets new requirements of diminishing the antenna structures used in the devices. However, the size of an antenna depends on the principles of physics, since the bandwidth of antenna resonance depends on the Q value of the antenna structure such that the lower Q value an antenna has, the wider is the available bandwidth. The easiest way to lower the Q value of an antenna is to make the antenna larger, but if the space required by the antenna is limited, it is extremely difficult to lower the Q value.

An advantage of planar inverted F antennas (PIFA) is their small size, allowing them to be integrated into a device so that they are entirely disposed inside said device. FIG. 1*a* shows a prior art conventional PIFA antenna element 100, the antenna element 100 comprising a planar radiator 110, a ground plane 120, a ground point 102 and a feed point 101. The length of edges 104 and 105 of the radiator 110 is 40.0 mm, the length of edges 107 and 108 is 25.0 mm, and the feed point is located at a 2.0-mm distance from both edge 108 and edge 104. The width of the grounding line of the ground point 102 is 5.0 mm and it is located at the edge 104, so that a centre parallel to the edge 104 of the grounding line is located at a 12.5 mm distance from the edge 108. The length of edges 121 and 122 of the ground plane is 100.0 mm, the length of edges 123 and 126 is 40.0 mm, and the distance between the ground plane 120 and the radiator 110 is 5.0 mm. Either air or another dielectric material is provided as insulating material between and on top of the ground plane 120 and the radiator 110. The radiator 110 of the PIFA antenna is coupled to the ground plane 120 via the ground point 102. The shape of the ground point may be dotted or similar to the grounding line shown in FIG. 1*a*. Below, reference 102 denotes the ground point and the grounding line. The physical dimensions of the radiator 110 and the ground point 102 and the distance between the radiator element and the ground plane affect the resonance frequency of a PIFA antenna. The radiator 110 is fed either from the edge of the radiator or by conveying a feeder line through the ground plane and the insulating material as FIG. 1*a* shows. A change in the width of the grounding line of the ground point 102 causes a change in the resonance frequency of the antenna. A decrease in the width of the grounding line causes a decrease in the resonance frequency; similarly, a wider grounding line increases the resonance frequency. The grounding line may be either as wide as the side of the antenna element or, at its narrowest, only a conductor.

The major problem in PIFA antennas is a narrow impedance band, resulting mainly from the distance between the radiator of the antenna and the ground plane with respect to the wavelength.

FIG. 1*b* illustrates the frequency band of the antenna structure of FIG. 1*a* using the above dimensions. In the graph, the x-axis shows frequency in GHz and the y-axis the radiation efficiency of the antenna element [%], antenna efficiency [%] and antenna matching (S11) [dB]. FIG. 1*b* shows that the frequency band of the antenna structure of FIG. 1*a*, at 50% antenna efficiency, is in the range of about 1400 to 1700 MHz.

The radiation efficiency of an antenna element refers the radiation efficiency of the antenna element when the antenna is matched. Antenna efficiency refers to the efficiency of the antenna when the efficiency includes antenna matching.

Attempts have been made to increase the bandwidth of a PIFA antenna for example by creating parallel resonators in the antenna structure. FIG. 2*a* shows an antenna structure, wherein resonances are generated with two antenna elements 201 and 202 of slightly different lengths, of which the smaller element 202 generates a higher frequency resonance and the larger element 201, a lower frequency resonance.

FIG. 2*b* shows an antenna structure having a main element 205 and a parasitic element 206, the elements 205 and 206 being separated from one another along the entire length to generate resonances. However, the increase in the bandwidth of the above antennas remains relatively small compared with the bandwidth created by the antenna of FIG. 1*a*.

An arrangement of several adjacent resonances is a way to increase the bandwidth of an antenna. Matching of an antenna element may provide the adjacent resonances. Matching can be carried out for example with a feed and grounding strip, allowing the impedance of the strips to be arranged as desired by means of dimensioning the width and length of the strips and by means of the relationship between the mutual distances between the strips. Resonances provided with matching are easily lossy, which may result in a loss of the gain achieved by matching.

In the solution carried out on the antenna element, grooves are added to the antenna element to increase the number of resonance frequencies. However, grooves easily act as groove radiators in small antennas, making adjacent resonating antenna elements couple strongly to one another providing a resonator around the groove. This further results in the radiation resonance being low at said frequency and current densities being high in the vicinity of the groove, increasing the losses of the antenna.

The Applicant's earlier European patent application 1 020 948 discloses a dual band antenna structure having a first groove for providing resonance in the higher 1800 MHz frequency range. The radiator also comprises a second groove that branches from said first groove. Increasing the width of the second groove decreases the bandwidth in the GSM 1800 MHz frequency range and decreases the amplification of the resonance element in the GSM 900 MHz frequency range. Increasing the length of the second groove increases the bandwidth in the GSM 900 MHz frequency range and decreases the amplification in the 1800 MHz frequency range. In said antenna structure, said second groove provides an increase in bandwidth in the lower frequency range (900 MHz) and a decrease in the higher frequency range (1800 MHz). This kind of solution is thus not well suitable for use in cases when the attempt is to accomplish as wide a bandwidth as possible for the upper frequency range.

SUMMARY OF THE INVENTION

An antenna structure is now provided for use particularly, but not necessarily, in mobile systems, the implementation allowing the Q value of an antenna to be lowered, thereby causing an increase in its bandwidth. A feed point and a ground point, arranged in the radiator of the antenna structure, the radiator comprising a planar electrically conductive surface, are separated from one another with a groove that is arranged in the planar radiator such that a line segment, to be provided between the feed point and the ground point, cuts the groove. The smaller portion of the groove is provided on the side of the line segment cutting the groove comprising the open end of the groove, and, correspondingly, the larger portion of the groove is provided on the opposite side of said line segment. The addition of a groove of the type described above to a radiator results in a change in some paths of surface currents distributed to the surface of the radiator, causing the antenna to generate a plurality of resonances and increasing the bandwidth at good radiation efficiency. The substantial length of the groove exceeds a quarter of the wavelength of the highest resonance frequency. The length is defined as the straightest possible path within the groove between the starting and end points. The starting point of said path is located in the middle of the open end of the groove. The end point is located at that point of the edge of the radiator within the groove, to which the distance of the straightest possible path within the groove, measured from the starting point to said end point, is at its longest.

The groove provides an open space in the middle area of the antenna, thereby also decreasing the capacitive coupling of the different antenna element parts. A further advantage is that the space used by the antenna is utilized as efficiently as possible.

A first aspect of the invention provides an antenna structure comprising a ground plane, a radiator located at a distance from the ground plane, an insulating layer between said ground plane and said radiator, at least one feed point for feeding a signal to said radiator, at least one ground point for grounding the radiator to the ground plane, in that the radiator comprises at least one groove comprising an open end and a closed end, the groove being arranged at least partly between said at least one feed point and said at least one ground point such that a line segment to be created between said feed point and said ground point cuts said groove, whereby a smaller portion of the groove is arranged on that side of the line segment cutting the groove, on which the open end of the groove is provided, and a larger portion of the groove is provided on the opposite side of the line segment cutting the groove, on which side the closed end of the groove is arranged.

A second aspect of the invention provides a radio device comprising an antenna structure for transmitting a radio-frequency signal, the antenna structure further comprising a ground plane, a radiator arranged at a distance from the ground plane, an insulating layer between said ground plane and said radiator, at least one feed point for feeding a signal to said radiator, at least one ground point for grounding the radiator to the ground plane, in that the radiator comprises at least one groove comprising an open end and a closed end, the groove being located at least partly between said at least one feed point and said at least ground point such that a line segment to be created between said feed point and said ground point cuts said groove, whereby a smaller portion of the groove is arranged on that side of the line segment cutting the groove, on which the open end of the groove is provided, and a larger portion of the groove is provided on the opposite side of the line segment cutting the groove, on which side the closed end of the groove is arranged.

BRIEF DESCRIPTION OF THE DRAWINGS

The prior art was discussed with reference to FIGS. 1 and 2. In the following, the invention will be described in greater detail with reference to FIGS. 3 to 5, in which.

DETAILED DESCRIPTION

Figure 3A:
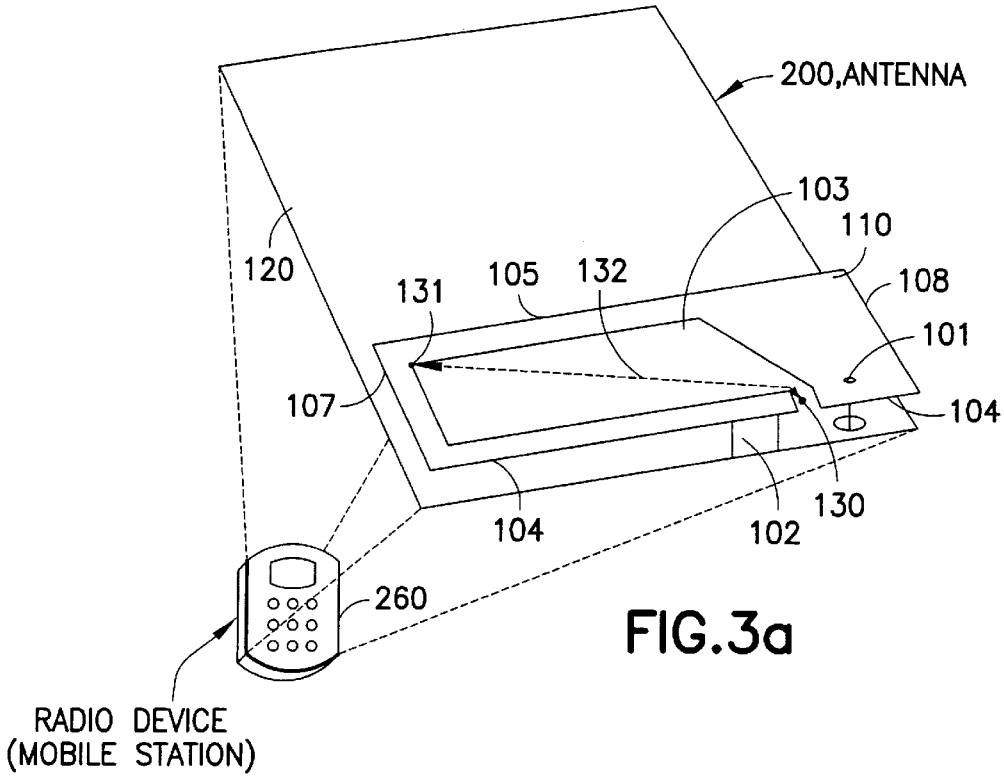
FIG. 3*a* illustrates the structure of an antenna element according to the invention.

FIG. 3*a* illustrates, by means of an exploded view, the structure of an antenna element 200 according to the invention, the basis being a planar PIFA antenna, forming a part of a radio device such as a mobile station, and being enclosed within a case 260 of the radio device. The antenna element 200 comprises a ground plane 120, a planar radiator 110, a feed point 101, a grounding line 102 for a ground point, and a groove 103. Said groove 103 is a portion that is not of electrically conductive material. The groove may be implemented for instance by removing electrically conductive material from the radiator 110. The dimensions of the antenna structure 200 correspond to those of the antenna structure 100 in FIG. 1*a*. The width of the narrower portion of the groove 103 at an edge 104 is 1.0 mm. The groove 103 divides the edge 104 into two portions, the length of the longer portion being 34.0 mm and the length of the shorter portion 5.0 mm. The distance between the broader portion of the groove 103 and edges 104, 105 and 107 is at its shortest 5.0 mm. The distance between the broader portion of the groove 103 and an edge 108 is at its shortest 5.0 mm and at its longest 14.0 mm. The substantial length (reference 132) of the groove is 37.6 mm, measured from a starting point 130 to and end point 131.

The feed point is implemented as a coaxial feed through the ground plane such that it is located at a substantial distance from the nearest edges of the radiator. The feed point may also be implemented at the edge of the radiator 110 in the same way as the grounding line 102 of the ground point. The location depends on the practical arrangement of the antenna element, which is best optimized by the location of the feed point. The grounding line 102 of the ground point is located substantially at the edge 104 of the radiator 110. The ground point may also be located at a substantial distance from the edge 104. The shape of the ground point 102 may also be point formed, such as the feed point 101, and it may be located, as the feed point, at a substantial distance from the edges of the radiator.

The groove 103 divides the edge 104 into two parts, whereby the groove 103 divides the radiator 110, seen from the edge 105, into a branch on the side of the ground point and a branch on the side of the feed point such that the edges 105, 107 and 108 remain unbroken. In the antenna structure of the invention, the groove 103 is located at least partly between the feed point 101 and the ground point 102 such that a line segment 151 (shown in FIG. 4*a* for clarity, but applicable to all embodiments of FIGS. 3*a*, 4*a* and 5*a*), to be created between the feed point 101 and the ground point 102, cuts the groove 103, whereby the smaller portion of the groove 103 is arranged on that side of the line segment cutting the groove 103, on which side the edge 104 of the radiator 110 forms the open end of the groove 103. When the groove 103 portions on different sides of the line segments are observed on an axis parallel to the edge 107 such that the line segment is created in the middle of the grounding line of the ground point at the edge 104, then about 8% of the groove is situated in an area between said line segment and the edge 104, and, correspondingly, about 92% on the opposite side of the line segment. When the distribution of the area of the groove 103 is observed on the different sides of the line segment, about 0.5% is located on the area on the side of the line segment and the edge 104 and about 99.5% on the other side of the line segment. These ratios are given as examples of values applicable to the structure of FIG. 3*a*; the ratios may also be different from those mentioned. A change in said ratios by a change in the shape of the groove, such as its length or width and/or a change in the locations of the feed or ground points always brings about a change in the radiation power and resonance frequencies generated by the antenna.

In the antenna structure of FIG. 3*a*, the width of the groove 103 at the end on the side of the edge 104 is substantially narrower than elsewhere, but it may also be broader. Substantially in the longitudinal direction of the groove 103, the groove is broader than at the end on the side of the edge 104. The groove 103 may also be equally broad at both ends of the groove. The substantially narrow portion of the groove 103 at the end on the side of the edge 104 is arranged perpendicularly against the edge 104; perpendicularity is not a requirement, but the groove 103 may also be located at an angle with respect to the edge 104. The substantially broader portion of the groove 103 is so implemented that the broader portion of the groove is arranged parallel to the edge 104, in the area on the side of the ground point 102 of the radiator 110. The broader portion of the groove 103 may also be arranged diagonally with respect to the edge 104.

The shape of the groove 103 is not limited to that shown in FIG. 3*a*, but its substantial proportion of length to width can be larger or smaller than is shown in the figure. The location of the feed point in the area of the radiator is not either limited for use only in the area of the radiator as shown in FIG. 3*a*. The feed point may also be located at the edge of the radiator, as may the ground point 102. The location of the ground point is not either limited to the edge of the radiator, but it may be located at a substantial distance from the edges of the radiator, as may the feed point.

Figure 1A:
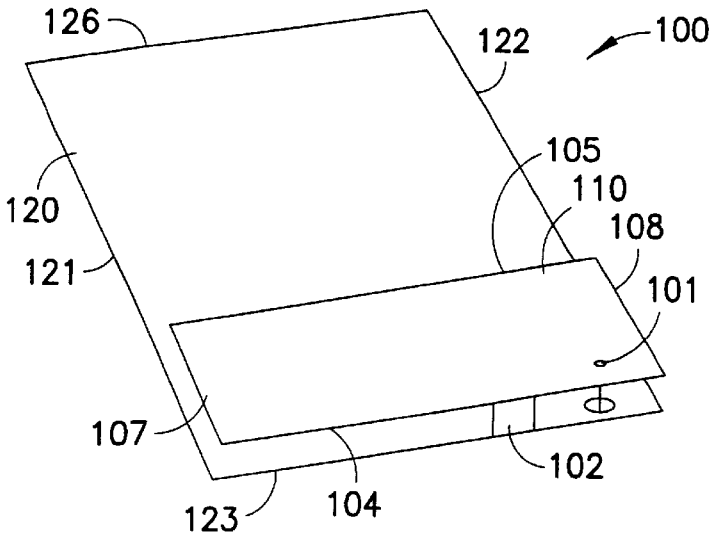
FIG.1a PRIOR ART
FIG. 1*a* illustrates the structure of a prior art PIFA antenna element.
Figure 2A:
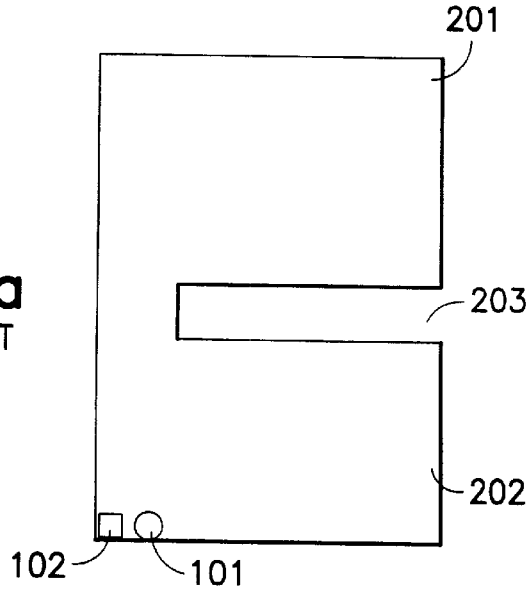
FIG.2a PRIOR ART
FIGS. 2*a* and 2*b* illustrate prior art structures of a PIFA antenna element.
Figure 2B:
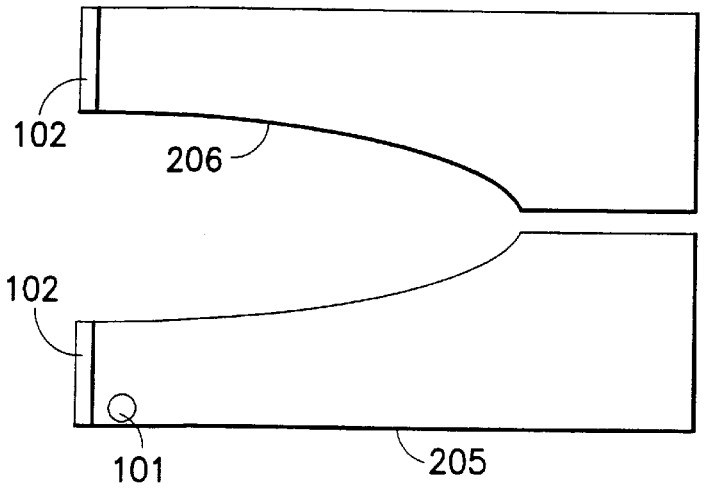
FIG.2b PRIOR ART
Figure 1B:
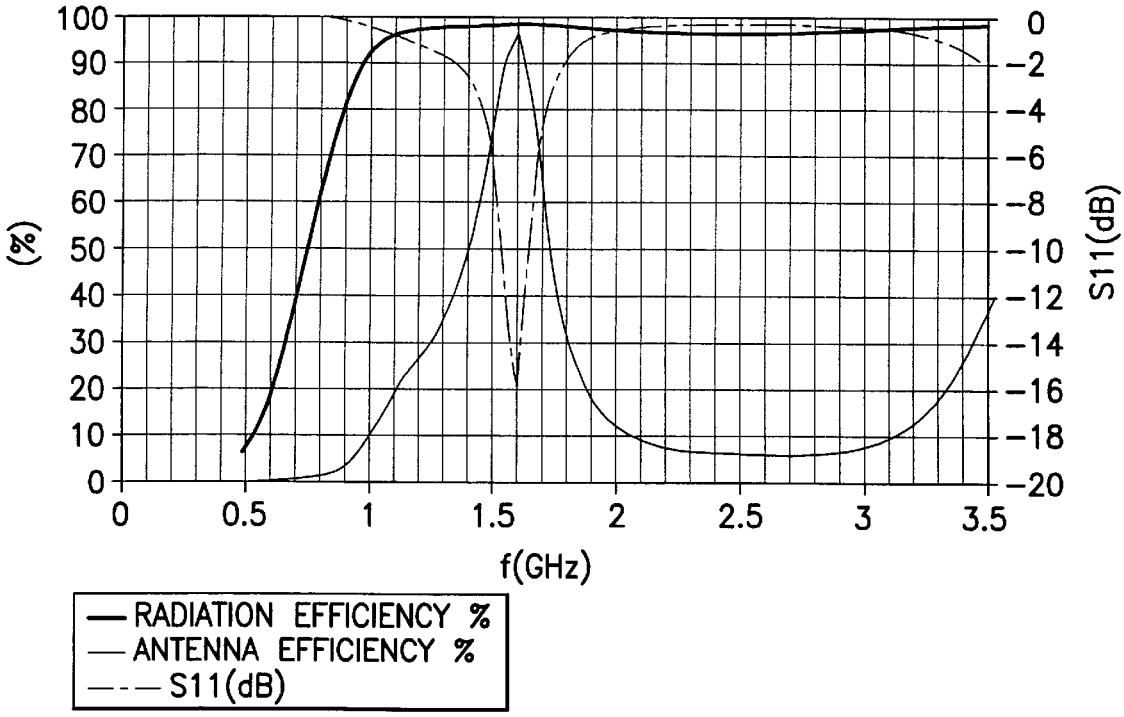
FIG. 1b PRIOR ART
FIG. 1*b* illustrates the frequency band of the PIFA antenna according to FIG. 1*a,*
Figure 3B:
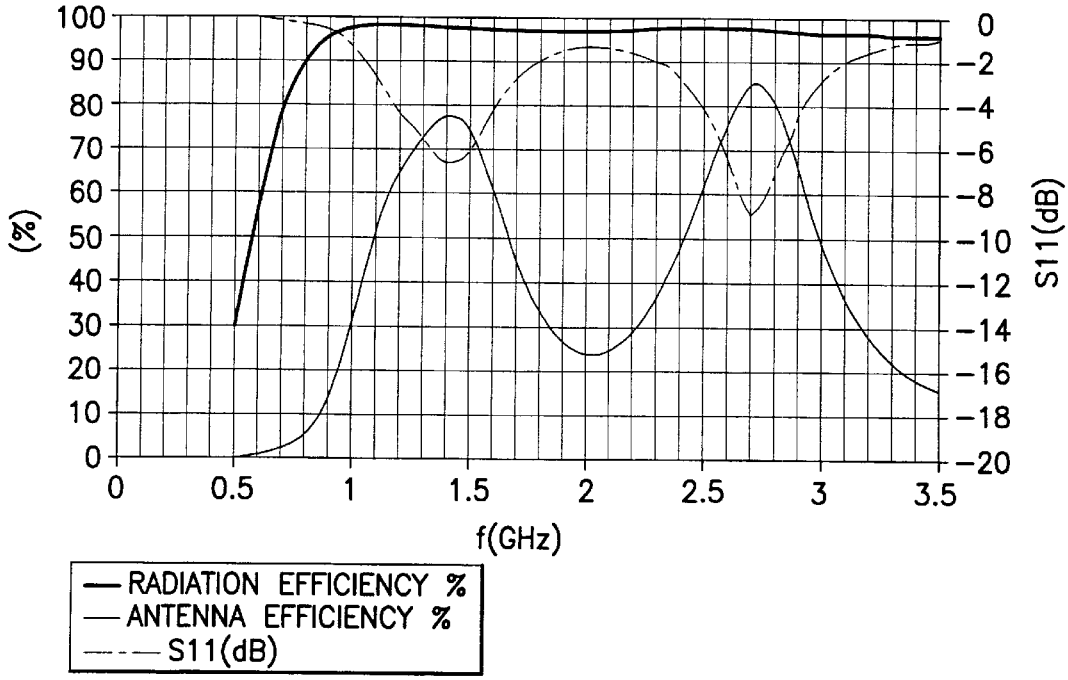
FIG. 3*b* illustrates the frequency band of the antenna element of FIG. 3*a,*

FIG. 3*b* illustrates the frequency band of the antenna element 200 of FIG. 3*a*. In the graph, the x-axis gives frequency in GHz and the y-axis radiation efficiency [%], antenna efficiency [%] and antenna matching (S11) [dB]. On comparison of the frequency band of the antenna element of FIG. 1*a* with the one shown in FIG. 1*b*, the frequency band of the antenna structure of the invention in FIG. 3*b* now also comprises a second higher frequency band, which, observed at 50% antenna efficiency, is located in the range of about 2400 to 3000 MHz. In addition, the first frequency band, which was located in the range of about 1400 to 1700 MHz when observed at 50% antenna efficiency according to the antenna structure of FIG. 1*a*, is now in the range of about 1100 to 1700 MHz when observed at the same efficiency, indicating a bandwidth increase of about 300 MHz compared with the previous. When the radiation efficiencies of FIGS. 1*b* and 3*b* are compared, it may also be noted that the groove 103 provided did not lower the radiation power at the frequency range employed.

Figure 4A:
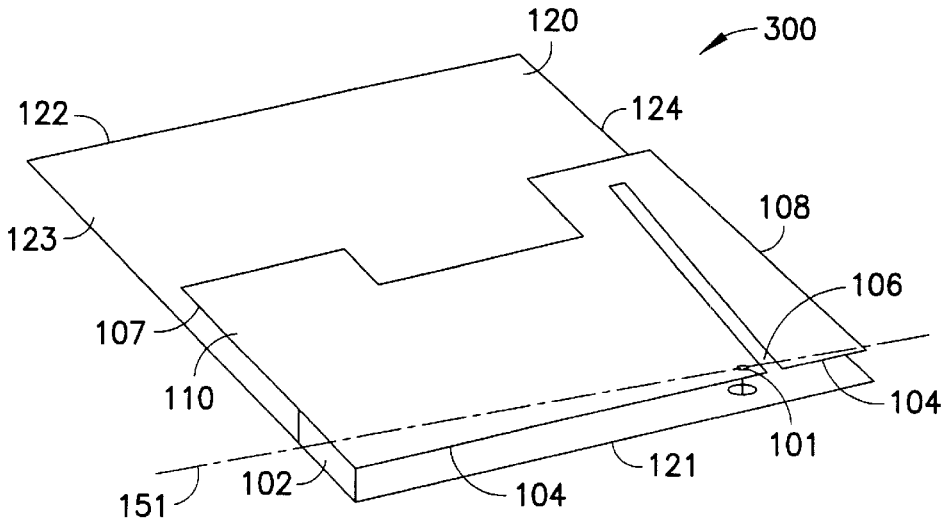
FIG. 4*a* illustrates the structure of an antenna element to be used in more than one frequency range.

FIG. 4*a* illustrates, for later comparison, the structure of a dual band antenna element 300, based on a prior art planar dual band PIFA antenna. The antenna element 300 comprises a ground plane 120, a planar radiator 110, a feed point 101, a grounding line 102 for a ground point, and a groove 106.

The length of edges 121 and 122 of the ground plane 120 is 46.0 mm, and the length of edges 123 and 124 is 105.0 mm. The ground plane is located at a 5.0-mm distance from the radiator 110. The width of the groove 106 is 1.0 mm and the length 42.0 mm, and its distance from an edge 108 is 6.0 mm at its shortest and at its longest equal to the length of an edge 114, i.e. 10.0 mm. The length of an edge 104 is 35.0 mm, the length of an edge 107 is 38.0 mm and the length of the edge 108 is 45.0 mm. The feed point 101 is located at a 2.0-mm distance from the edge 104 and at a 12.0-mm distance from the edge 108. The length of the grounding line of the ground point 102 parallel to the edge 107 is 11.0 mm.

The feed point 101 is implemented as a coaxial feed through the ground plane such that it is located at a substantial distance from the nearest edges of the radiator 110. The feed point may also be implemented at the edge of the radiator 110 in the same way as the grounding line 102 of the ground point. The location depends on the practical arrangement of the antenna element, which is best optimized by the location of the feed point. The grounding line 102 of the ground point is located substantially at the edge 107 of the radiator 110 at the end on the side of the edge 104. The ground point may also be located at the edge 104 of the radiator 110, and, in addition, the shape of the ground point may be point formed, such as the feed point 101, and it may be located, as the feed point, at a substantial distance from the edges of the radiator. The groove 106 divides the edge 104 into two parts such that the groove is located in the area between the feed point 101 and the edge 108 flush with the radiator 110. The groove 106 does not have to be straight, but may be curved or winding. The groove 106 serves to generate a lower frequency range, and it is used to lengthen the electrical length of the element of the lower frequency range with respect to the wavelength.

Figure 4B:
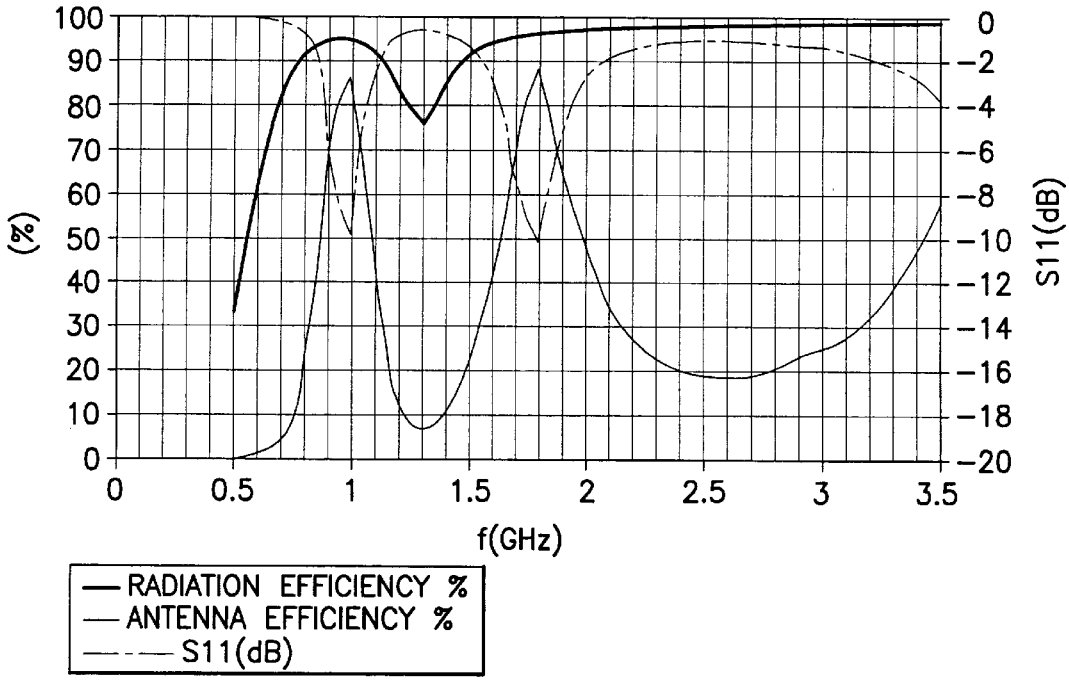
FIG. 4*b* illustrates the frequency band of the antenna element of FIG. 4*a,*

FIG. 4*b* illustrates, for later comparison, the frequency band of the antenna element 300 of FIG. 4*a*. In the graph, the x-axis shows frequency and the y-axis the radiation efficiency of the antenna element [%], antenna efficiency [%] and antenna matching (S11) [dB]. FIG. 4*b* shows that the lower frequency band of the antenna structure of FIG. 4*a*, at 50% antenna efficiency, is in the range of about 900 to 1100 MHz. The higher frequency band is located, at the same efficiency, in the range of about 1600 to 2000 MHz.

Figure 5A:
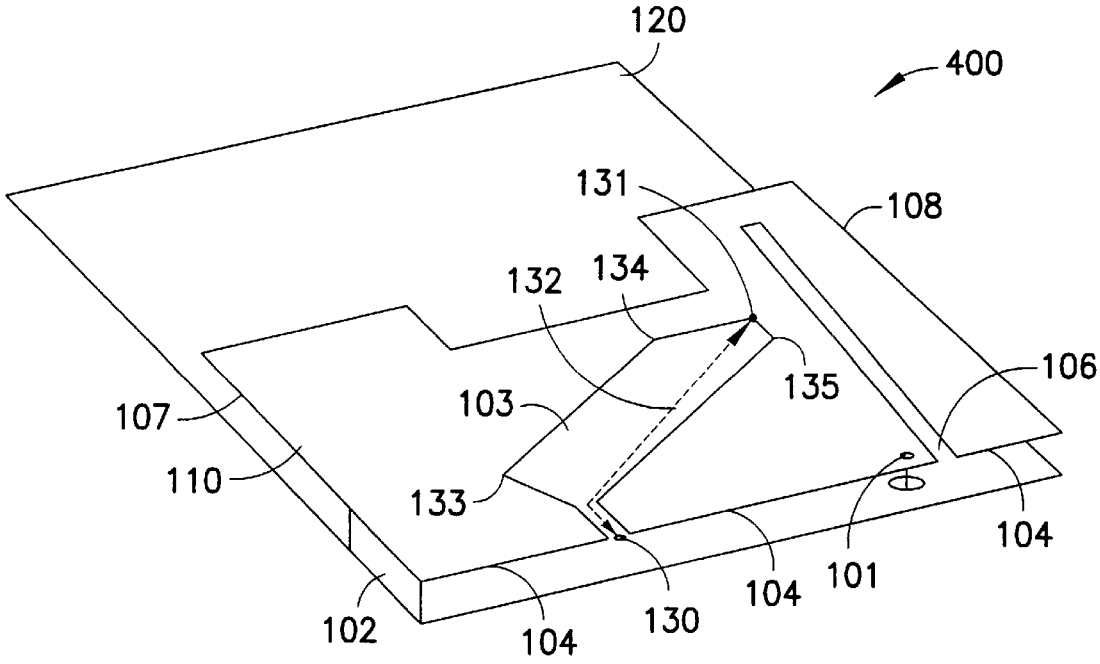
FIG. 5*a* illustrates the structure, according to the invention, of an antenna element to be used in more than one frequency range.

FIG. 5*a* illustrates an antenna element 400 structure of having both the groove 106 in addition to the novel groove 103, the invention for use in more than one frequency range, the basis being a planar dual band PIFA antenna according to FIG. 4*a*. As may be noticed by inspection of FIGS. 4*a* and 5*a*, the material presented in FIG. 5*a* is the same as that presented in FIG. 4*a* except for the omission of FIG. 4*a* of the material describing the groove 103 in order to show more readily in FIG. 4*a* the portion of the antenna relating to the groove 106 for production of the lower frequency range, described above. The antenna element 400 comprises a ground plane 120, a planar radiator 110, a feed point 101, a grounding line 102 for a ground point, a first groove 106 and a second groove 103. Said grooves 106 and 103 are portions that do not comprise electrically conductive material.

The outer dimensions of the antenna structure 400 correspond to those of the antenna structure 300 shown in FIG. 4*a*. The length of the narrower portion of the groove 103 is 10.0 mm, width 1.0 mm, and it is located at a 15.0-mm distance from the edge 107. The width of the broader portion of the groove 103 from the first edge (reference 133–reference 134) to the second edge (reference 135–reference 136) is 10.0 mm. The substantial length (reference 132) of the groove, measured from the starting point 130 to the end point 131, is about 31.0 mm.

The feed point 101 is implemented as a coaxial feed through the ground plane such that it is located at a substantial distance from the nearest edges of the radiator. The location depends on the practical arrangement of the antenna element, which is best optimized by the location of the feed point. The grounding line 102 of the ground point is located substantially at the edge 107 of the radiator 110 at the end on the side of the edge 104. The ground point may also be located at the edge 104, and, in addition, it may be located at a substantial distance from the edges 104 and 107.

The groove 106 divides the edge 104 into two parts such that the groove is located in the area between the feed point 101 and the edge 108. The groove 106 serves to generate a lower frequency range, whereas the feed point 101 and the ground point 102, and the groove 103 generate the upper frequency range or upper frequency ranges. The groove 103 further divides the element on he side of the feed and ground points (101 and 102) at the edge 104 into two parts, making the radiator 110 now branch to the element on the side of the ground point, the element on the side of the feed point, and, in addition, to the element on the side of the edge 108. In the antenna structure of the invention, the groove 103 is located at least partly between the feed point 101 and the ground point 102 such that a line segment to be created between the feed point 101 and the ground point 102 cuts the groove 103, whereby a smaller portion of the groove 103 forms on that side of the line segment cutting the groove 103, on which the edge 104 of the radiator 110 forms the open end of the groove 103.

When the portions of the groove 103 on different sides of the line segment are observed on an axis parallel to the edge 107 such that the line segment is created in the middle of the grounding line of the ground point at the edge 104, about 8% of the groove is located in the area between said line segment and the edge 104, and, correspondingly, about 92% on the other side of the line segment. When the division of the area formed by the groove 103 on the different sides of the line segment is observed, about 0.5% is located on the area on the side of the line segment and the edge 104, and about 99.5% on the other side of the line segment. These ratios are given as examples of values applicable to the structure of FIG. 5*a*; the ratios may also be different from those mentioned. A change in said ratios by a change in the shape of the groove, such as its length or width and/or a change in the locations of the feed or ground points always brings about a change in the radiation power and resonance frequencies generated by the antenna.

The shape of the groove 103 is not limited to that shown in FIG. 5*a*, but its substantial length and width can be larger or smaller than is shown in FIG. 5*a*. The location of the feed point in the area of the radiator is not either limited for use only in the area of the radiator as shown in FIG. 5*a*. The feed point may also be located at the edge of the radiator, as may the ground point 102. The location of the ground point is not either limited to the edge of the radiator, but it may be located at a substantial distance from the edges of the radiator, as may the feed point.

Figure 5B:
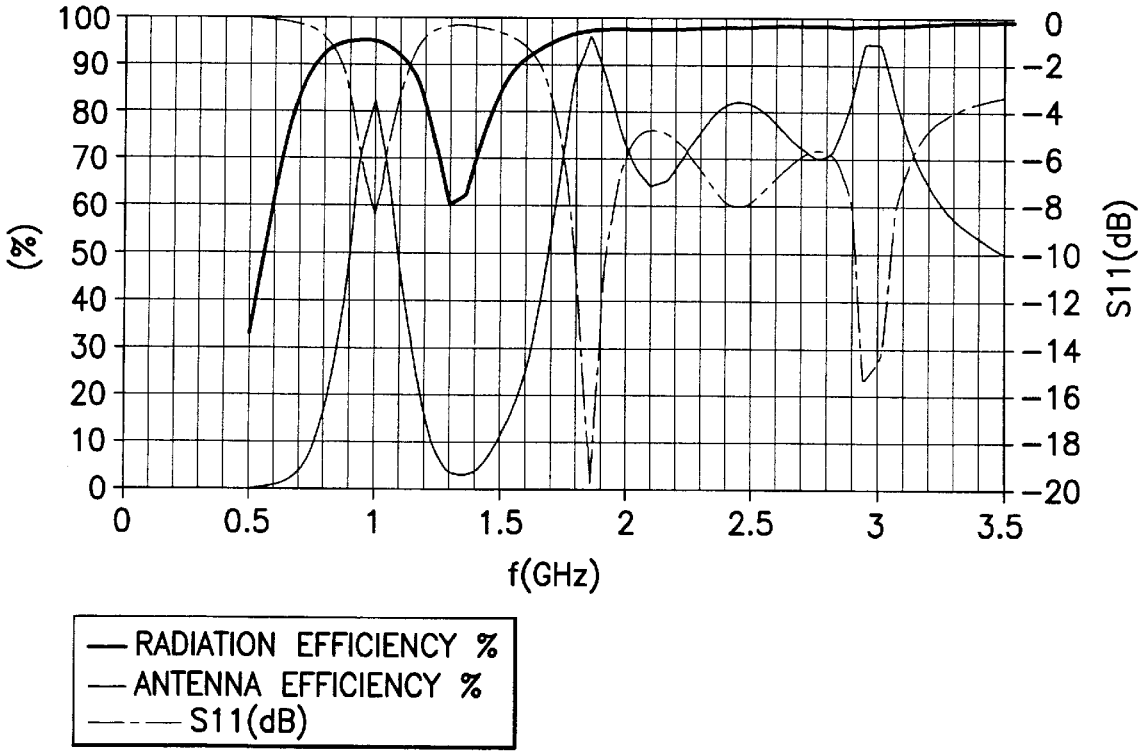
FIG. 5*b* illustrates the frequency band of the antenna element of FIG. 5*a.*

FIG. 5*b* illustrates the frequency band of the antenna element of FIG. 5*a*. In the graph, the x-axis gives frequency in GHz and the y-axis the radiation efficiency of the antenna element [%], antenna efficiency [%] and antenna matching (S11) [dB]. FIG. 5*b* shows that the lower frequency band of the antenna structure of FIG. 5*a*, at 50% antenna efficiency, is in the range of about 900 to 1100 MHz. The higher frequency band is located, at the same efficiency, in the range of about 1700 to 3500 MHz. On comparison of the results now presented with the results of the antenna element of FIG. 4*a* in FIG. 4*b*, it may be noted that the bandwidth increase generated by the groove 103 in the antenna structure of FIG. 5*a* is significant at the higher frequency compared with an antenna structure without the implementation of the invention. A further advantage is that in the implementation of the invention, the new structure does not compromise the radiant power of the antenna.

When the simulation results of the antenna structure of FIG. 4*a* are observed, the frequency band at the lower frequency is located, at 50% antenna efficiency, in the range of about 900 to 1100 MHz and at the upper frequency in the range of about 1600 to 2000 MHz, resulting in a bandwidth of about 200 MHz at the lower frequency and about 400 MHz at the upper frequency. The results of the antenna structure of the invention in FIG. 5*a* are similar at the lower frequency, but at the upper frequency the frequency range is now in the range of about 1700 to 3500 MHz, resulting in a bandwidth of about 1800 MHz. Consequently, the groove according to the invention in an antenna structure increases bandwidth at the upper frequency almost fivefold compared with a conventional antenna structure without harmful effects on the bandwidth of the lower frequency range or the location of said frequency range.

The antenna structure of the invention is applicable to all present digital mobile and cellular communication systems. The antenna of the invention may be used in the implementation of multi-frequency antenna solutions in all mobile stations or small radio devices for which an internal antenna is a preferable feature. The invention is particularly applicable to such mobile stations that use two or more separate frequency ranges or combinations of these frequency ranges. An example is a mobile station comprising the EGSM (880 to 960 MHz), PCN (DCS 1800; 1710 to 1880 MHz) and W-CDMA system (1920 to 2170 MHz), whereby the EGSM system would operate at the lower frequency range created by the antenna structure of the invention and the PCN and W-CDMA systems at the upper frequency range created by the antenna structure. Since the antenna solution of the invention provides a wide continuous frequency range, the antenna is therefore not critical to, for example, frequency changes caused by the environment. Furthermore, costs are saved in manufacture and design, since the same antenna structure is applicable to different frequency ranges, allowing it to be manufactured in larger numbers, resulting in lower production costs.

The design of the groove in the antenna structure of the invention can be used to affect e.g. antenna feed matching, width of frequency band, frequency range, efficiency and the electrical length of the antenna. However, the invention is not restricted to the groove shapes presented, but the groove may have another form, length or width. Said groove is always such a portion that does not comprise electrically conductive material. The groove can be implemented for example by removing from the radiator a groove-formed planar portion that extends through the radiator and contains electrically conductive material. If, in addition to a electrically conductive planar layer, the radiator comprises a planar layer of insulating material between the radiator and the ground plane, the groove can be implemented either by removing a groove-formed planar portion of electrically conductive material only, or by removing a groove-formed planar portion of both electrically conductive material and insulating material from the area forming the groove such that the groove extends through both said layers. A smaller portion, less than 50%, of the substantial length of the groove and the area of the groove is located in the area between the line segment to be created between the feed and ground point and the edge constituting the open end of the groove, and, correspondingly, a larger portion, more than 50% of the substantial length of the groove and the area of the groove is located on the other side of said line segment. Preferably the larger portion of the substantial length of the groove and the area of the groove in the area constituting the open end of the groove is always multifold in size compared with the smaller portion of the groove. The higher the proportion of said larger portion of the groove to said smaller portion of the groove, the better the antenna structure of the invention operates in the desired way.

The size of the ground plane with respect to the size of the radiator is not limited to any given ratio. The ground plane may be equal to or larger than the radiator, whereby the radiation pattern typically bears away from the ground plane to that side of the ground plane where the radiator is located. The ground plane may also be smaller than the radiator, whereby the antenna also radiates to the side in the direction of the portion radiating in a free space and to the opposite side of the ground plane. The radiator and the ground plane do not have to be planar surfaces. One or both of them may be for example curved or double-curved surfaces.

The invention is not either restricted to any given manner of implementing the antenna element or a material. The radiator and the ground plane may be preferably made from metal plate, such as copper plate or for example an insulating material coated with an electrically conductive layer or other materials suitable for making an antenna. Air is preferably used as the insulating layer between the radiator and the ground plane, in case the radiator is implemented as a self-supporting structure. Other insulating materials include body material of a circuit board, ceramic material or some other dielectric material or a combination thereof. The placement and number of feed and ground points are not either restricted to the above examples, but their number and placement may vary in a manner appropriate for the use of the antenna structure.

The implementation and embodiments of the invention were described herein by means of examples. It is obvious to a person skilled in the art that the invention is not limited to the details of the above embodiments, and that the invention can be implemented in another manner without departing from the characteristics of the invention. The embodiments presented should thus be considered as illustrative, not restrictive. The implementation and use of the invention are thus only limited by the attached claims. Accordingly, the different alternative embodiments defined by the claims, including equivalent implementations, are within the scope of the invention.

What is claimed is:

1. An antenna structure comprising a ground plane, a radiator located at a distance from the ground plane, an insulating layer between said ground plane and said radiator, at least one feed point for feeding a signal to said radiator, and at least one ground point for grounding the radiator to the ground plane, wherein the radiator comprises at least one groove comprising an open end and a closed end, the groove being arranged at least partly between said at least one feed point and said at least one ground point such that a line segment to be created between said feed point and said ground point cuts said groove, whereby a smaller portion of the groove is arranged on that side of the line segment cutting the groove on which the open end of the groove is provided, and a larger portion of the groove is provided on the opposite side of the line segment cutting the groove, on which side the closed end of the groove is arranged.

2. The antenna structure as claimed in claim 1, wherein said groove is arranged to generate at least one resonance frequency for the generation of at least one frequency band.

3. The antenna structure as claimed in claim 2, wherein said groove divides the antenna structure into a branch on the side of the feed point and a branch on the side of the ground point.

4. The antenna structure as claimed in claim 3, wherein said closed end of the groove is located at that point of the radiator at which the branch on the side of said ground point and the branch on the side of said feed point consolidate.

5. The antenna structure as claimed in claim 1, wherein said radiator comprises a planar surface.

6. The antenna structure as claimed in claim 1, wherein said radiator comprises a curved surface.

7. The antenna structure as claimed in claim 1, wherein said radiator also comprises a second groove for generating a resonance frequency for at least one frequency range.

8. The antenna structure as claimed in claim 7, wherein said groove is a portion not comprising electrically conductive material.

9. The antenna structure as claimed in claim 1, wherein said insulating layer is of dielectric material.

10. The antenna structure as claimed in claim 1, wherein said radiator and ground plane comprise a layer of electrically conductive material.

11. An antenna structure comprising a ground plane, a radiator located at a distance from the ground plane, an insulating layer between said ground plane and said radiator, at least one feed point for feeding a signal to said radiator, and at least one ground point for grounding the radiator to the ground plane, wherein the radiator comprises at least one groove comprising an open end and a closed end, the groove being arranged at least partly between said at least one feed point and said at least one ground point such that a line segment to be created between said feed point and said ground point cuts said groove, whereby a smaller portion of the groove is arranged on that side of the line segment cutting the groove on which the open end of the groove is provided, and a larger portion of the groove is provided on the opposite side of the line segment cutting the groove, on which side the closed end of the groove is arranged;

wherein said groove is arranged to generate at least one resonance frequency for the generation of at least one frequency band, said groove divides the antenna structure into a branch on the side of the feed point and a branch on the side of the ground point; and the open end of said groove is located at that point of the radiator at which the distance between the branch on the side of said ground point and the branch on the side of said feed point is equal to the size of the groove.

12. A radio device comprising an antenna structure for transmitting a radio-frequency signal, the antenna structure further comprising a ground plane, a radiator arranged at a distance from the ground plane, an insulating layer between said ground plane and said radiator, at least one feed point for feeding a signal to said radiator, at least one ground point for grounding the radiator to the ground plane, wherein the radiator comprises at least one groove comprising an open end and a closed end, the groove being located at least partly between said at least one feed point and said at least one ground point such that a line segment to be created between said feed point and said ground point cuts said groove, whereby a smaller portion of the groove is arranged on that side of the line segment cutting the groove, on which the open end of the groove is provided, and a larger portion of the groove is provided on the opposite side of the line segment cutting the groove, on which side the closed end of the groove is arranged.

13. The radio device as claimed in claim 12, wherein said radio device is a mobile station.

14. An antenna structure comprising a ground plane, a radiator located at a distance from the ground plane, an insulating layer between said ground plane and said radiator, at least one feed point for feeding a signal to said radiator, and at least one ground point for grounding the radiator to the ground plane, wherein the radiator comprises at least one groove comprising a closed end disposed in an interior portion of the radiator and an open end extending to and opening at an outer edge of the radiator, the open end of the groove passing at least partly between said at least one feed point and said at least one ground point such that a straight line segment extending between said feed point and said ground point cuts said groove into a smaller portion and a larger portion, the smaller portion of the groove being arranged on that side of the line segment on which the opening of the groove is provided, and the larger portion of the groove being provided on the opposite side of the line segment on which the closed end of the groove is arranged.

15. A radio device comprising an antenna structure for transmitting a radio-frequency signal, the antenna structure further comprising a ground plane, a radiator arranged at a distance from the ground plane, an insulating layer between said ground plane and said radiator, at least one feed point for feeding a signal to said radiator, at least one ground point for grounding the radiator to the ground plane, wherein the radiator comprises at least one groove comprising a closed end disposed in an interior portion of the radiator and an open end extending to and opening at an outer edge of the radiator, the open end of the groove passing at least partly between said at least one feed point and said at least one ground point such that a straight line segment extending between said feed point and said ground point cuts said groove into a smaller portion and a larger portion, the smaller portion of the groove being arranged on that side of the line segment on which the opening of the groove is provided, and the larger portion of the groove being provided on the opposite side of the line segment on which the closed end of the groove is arranged.

* * * * *